United States Patent [19]

Mackey

[11] 4,319,523

[45] Mar. 16, 1982

[54] APPARATUS FOR PRINTING LEATHER PRODUCTS

[76] Inventor: Charles P. Mackey, P.O. Box 847, Chickasha, Okla. 73018

[21] Appl. No.: 74,243

[22] Filed: Sep. 10, 1979

[51] Int. Cl.[3] ..... B44B 5/00

[52] U.S. Cl. ..... 101/3 R; 101/28; 69/2

[58] Field of Search ..... 101/3 R, 4, 30, 28, 101/29, 32; 69/2, 20

[56] References Cited

U.S. PATENT DOCUMENTS

| | | | |
|---|---|---|---|
| 1,497,872 | 6/1924 | Pollock | 101/3 R |
| 1,663,330 | 3/1928 | Baker et al. | 101/3 R X |
| 1,910,918 | 5/1933 | Hehn | 101/4 X |
| 3,584,572 | 6/1971 | Apicella | 101/30 X |

*Primary Examiner*—Clifford D. Crowder
*Attorney, Agent, or Firm*—Ely Silverman

[57] ABSTRACT

Apparatus supports each of several dies for concurrent application of equal displacement of all such dies relative to the to-be-embossed leather strip surface. The apparatus applies sufficient force to all of several dies, each of which provide different resistances to leather penetration to develop equal displacement of each of such dies into the leather and thereby provide embossed structure of uniform characteristic by all of said dies to produce a particular ornamental and decorative effect. The dies may be readily and rapidly replaced for a variety of names to different leather strips.

3 Claims, 29 Drawing Figures

FIG. 1
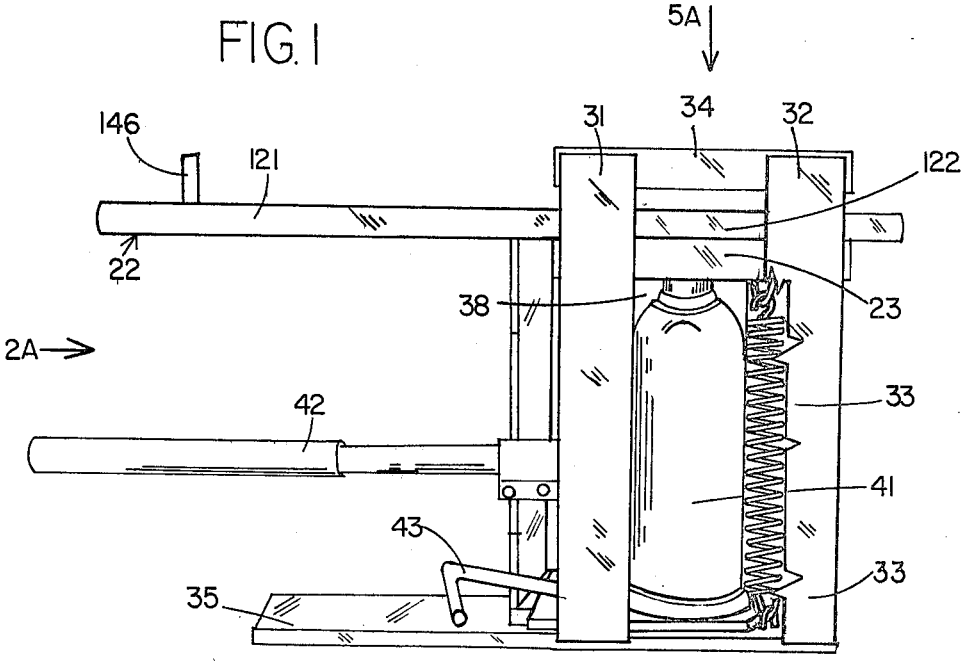
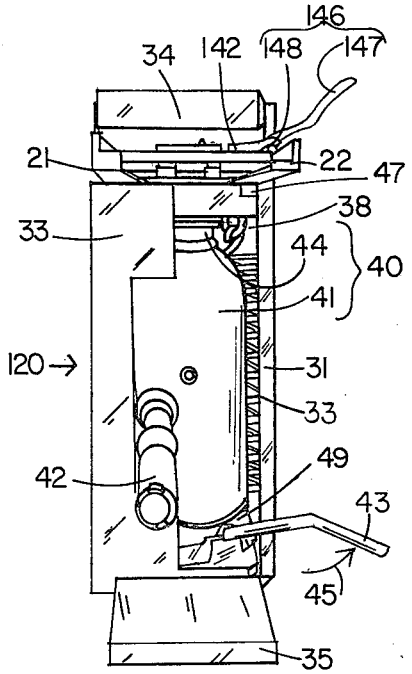
FIG. 2
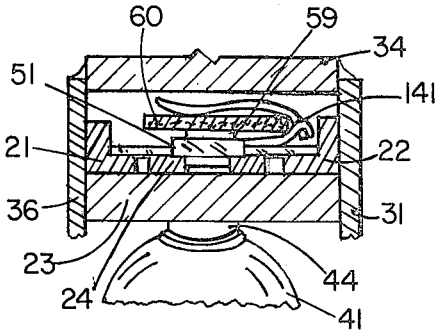
FIG. 3
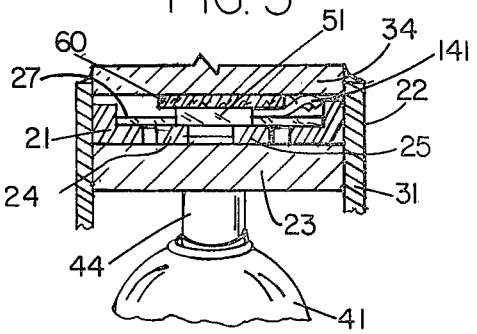
FIG. 4

FIG. 9
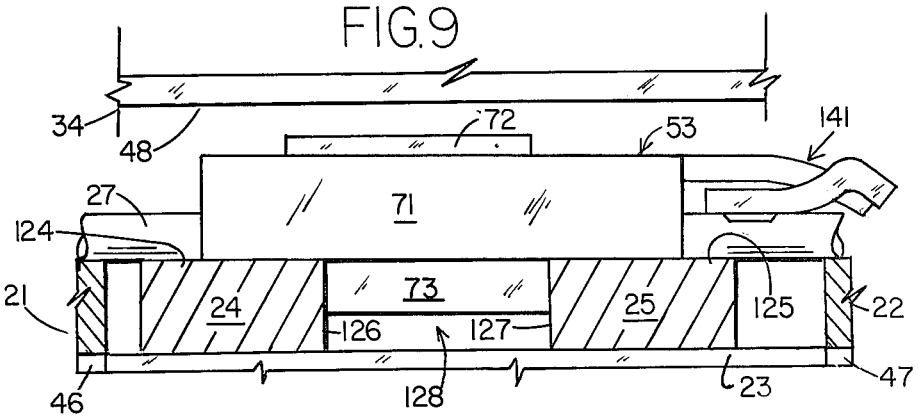
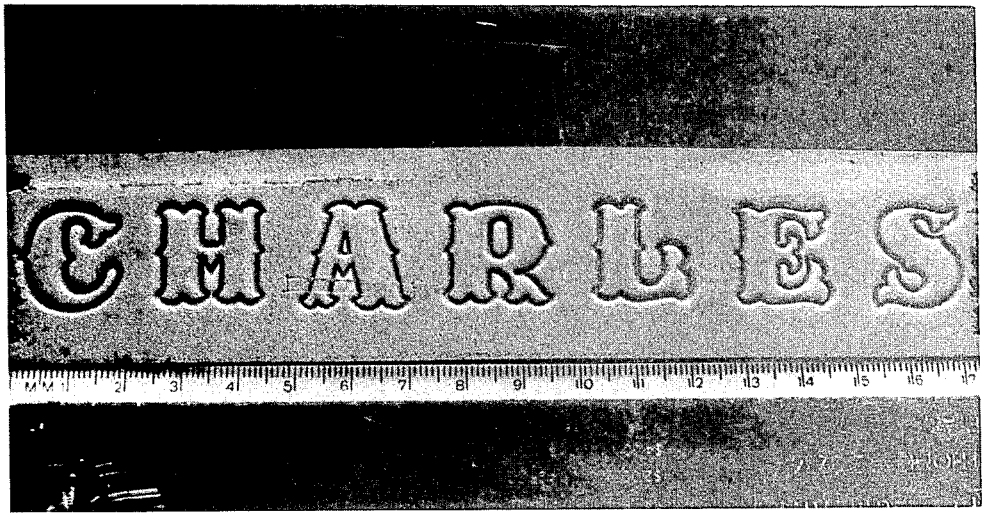
FIG. 10
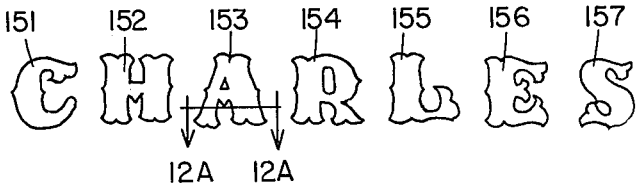
FIG. 11

FIG. 12
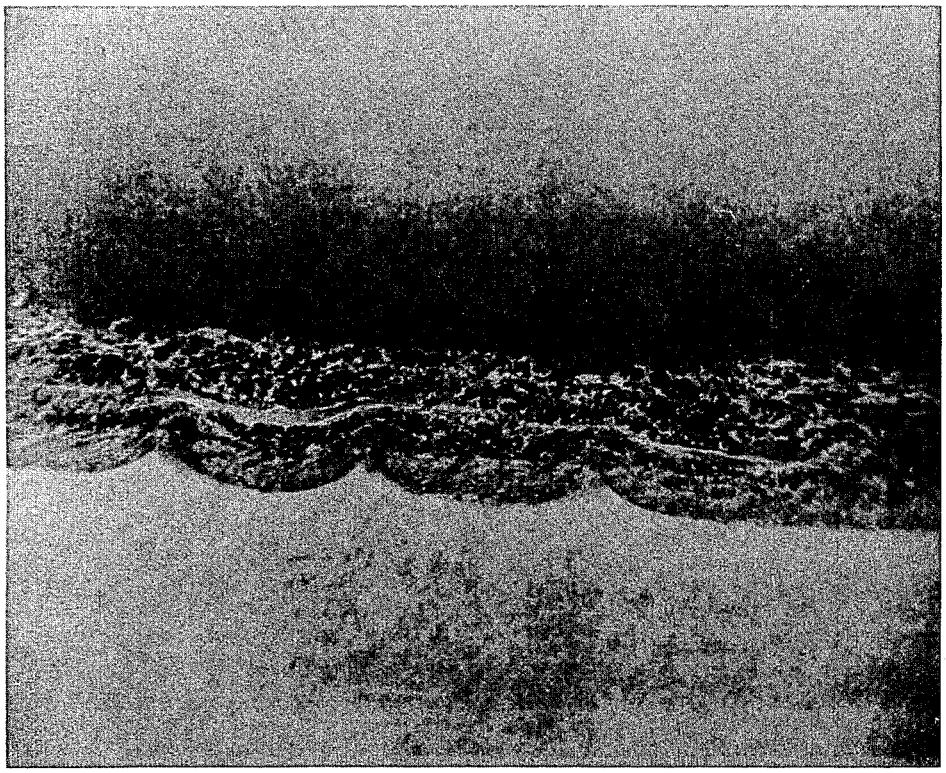
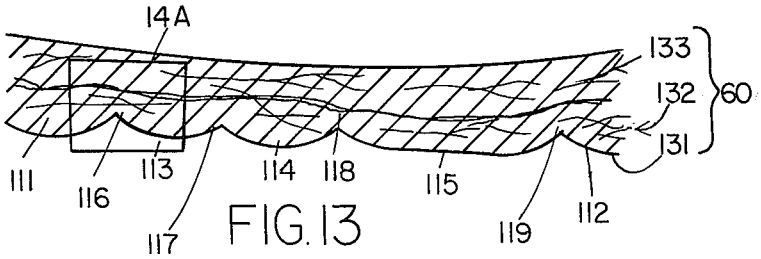
FIG. 13

FIG. 19
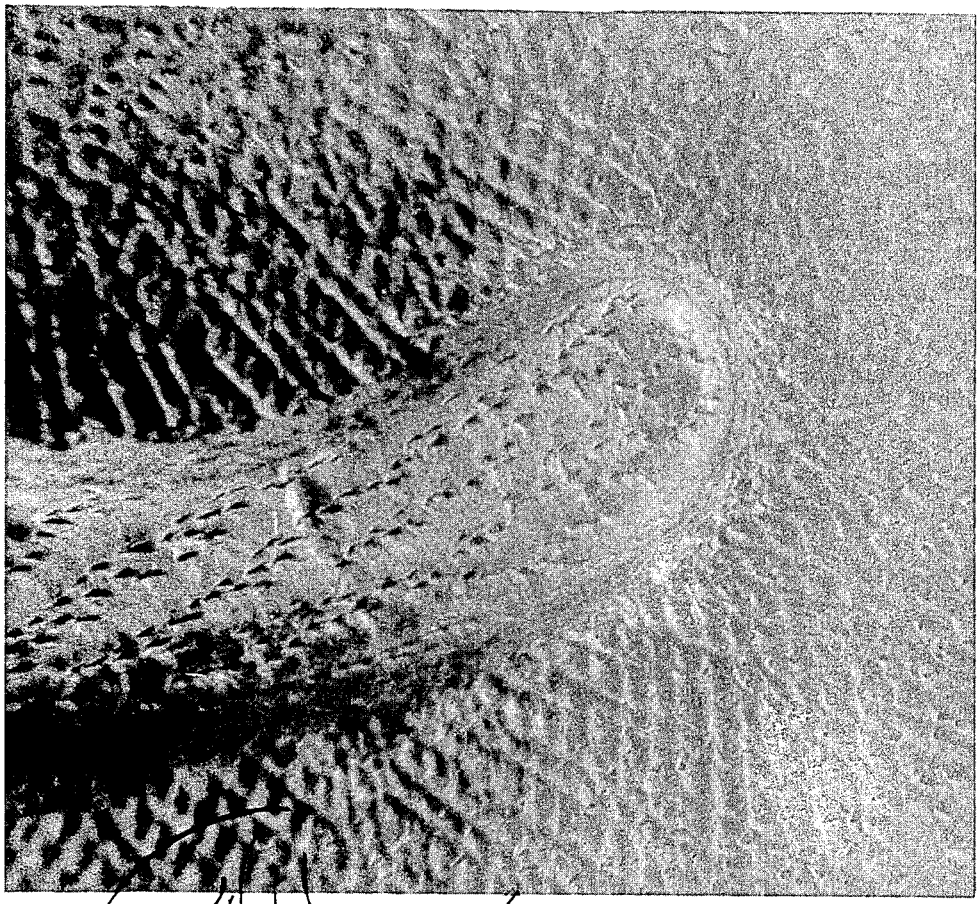
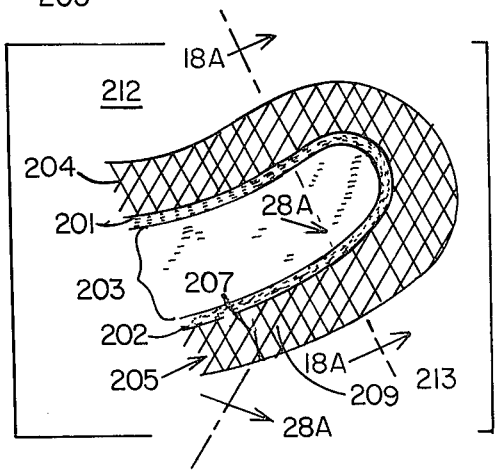
FIG. 20

APPARATUS FOR PRINTING LEATHER PRODUCTS

BACKGROUND OF THE INVENTION

1. Field of the Invention

The field of art to which this invention pertains is the impressing and indenting of leather.

2. Description of the Prior Art

While the prior art has developed successive use of single hand held dies for hand manipulation for embossing leather belts and like strips of leather such procedure is slow and uneconomical and does not consistently or reliably provide even textures and edge effects. Machines for rapid handling of groups of letters have also not provided flexibility and precision of control of the formation of such letters in repetitive or successive formation of embossed letter patterns, e.g. U.S. Pat. Nos. 2,690,910 and 3,655,940. The prior art simply has not successfully addressed itself to the specific requirements for consistently providing ornamental letters with sharply defined edges which are uniform for all letters of an array of embossed letters on a leather surface.

SUMMARY OF THE INVENTION

By the apparatus and process of this invention the surface of the leather is imprinted to uniform depths at letter edges and uniformly treated in the neighborhood of the edges if each of the letters in the array and the texture of the remaining leather portions is preserved. Because of such uniformity the letter designs are particularly ornamental. In one embodiment the process is arranged so that the edges of the letters are so formed with slots or recesses that in the bottom of each such slot or recess adjacent a stretched portion a fine pair of edges are provided adjacent to a ruptured portion of leather surface in each such slot or recess whereby a particularly sharp definition at the letter edge between the leather surface interior of the letter outline and the zone of leather surface exterior of the letter outline is achieved. In another form of product and process, because of the uniformity of operation provided to the letter edges and leather surface adjacent thereto filigree patterns are provided at the shoulder portions of the letter edges to provide an ornamental and artistic effect and structure which provides also for clearly defined letter edges. The particular apparatus and process herein provided provides for an extreme degree of sharpness of letter edges formed by embossing leather surfaces notwithstanding variations in the resistances of successive fed portions of leather to the embossing apparatus and, also, ready rapid, simple and reliable changes in the composition of arrays of letter dies so that short runs may be made and, in each of the products of each of such short runs, there will be crisp and uniform outlines in all of the letters of each array of letters embossed on the leather surface.

BRIEF DESCRIPTION OF THE DRAWINGS

FIG. 1 is an overall side view of the empty apparatus 120 with the jig support assembly 28 shown in its lowered position, and member 33 shown partly broken away.

FIG. 2 is a front end view of apparatus 120 taken along the direction of arrow 2A of FIG. 1 with a strip 60 in operative position in the apparatus 120.

FIG. 3 is a transverse vertical sectional view along section 3A—3A of FIG. 6 with apparatus 120 loaded with a leather strip 60 and jig support side members 21 and 22 in their lowered position.

FIG. 4 is a sectional view taken in the same direction and position as is FIG. 3 but with the jig support assembly side members 21 and 22 and die carrier jig members 24 and 25 shown in their raised position.

FIG. 9 is an enlarged diagrammatic cross-sectional view along section 9A—9A of FIG. 5.

FIG. 10 is a macrophotograph showing details of surface texture and structure of another leather strip imprinted by the apparatus 120 with name "CHARLES". This figure is provided with a scale graduated in millimeters and numbered centimeters (1–17) to show the size of components shown in this macrophotograph.

FIG. 11 is a reduced in scale line drawing of the macrophotograph shown in FIG. 10 for purposes of application of reference numbers thereto without interfering with the showings of details of texture and structure in FIG. 10.

FIG. 12 is a macrophotograph of a transverse vertical section taken along the section 12A—12A of FIGS. 10 and and in orientation of parts as in FIGS. 3 and 4.

FIG. 13 is a reduced in scale diagrammatic line drawing of some features of the sectional view provided in FIG. 12 for purpose of providing of reference numerals to features of FIG. 12 without interfering with showings of details in FIG. 12.

FIG. 19 is an enlarged macrophotographic view showing details of texture and structure in zone 19A of FIG. 16 and the corresponding portion of FIG. 17.

FIG. 20 is a reduced in scale diagrammatic line drawing of features shown in FIG. 19 for purpose of providing reference numbers to features of FIG. 19 without interfering with details shown in FIG. 19.

FIG. 26 is an enlarged view of zone 26A of FIG. 22. FIG. 27 is an enlarged view of zone 27A of FIG. 26.

DESCRIPTION OF THE PREFERRED EMBODIMENT

Figure 5:
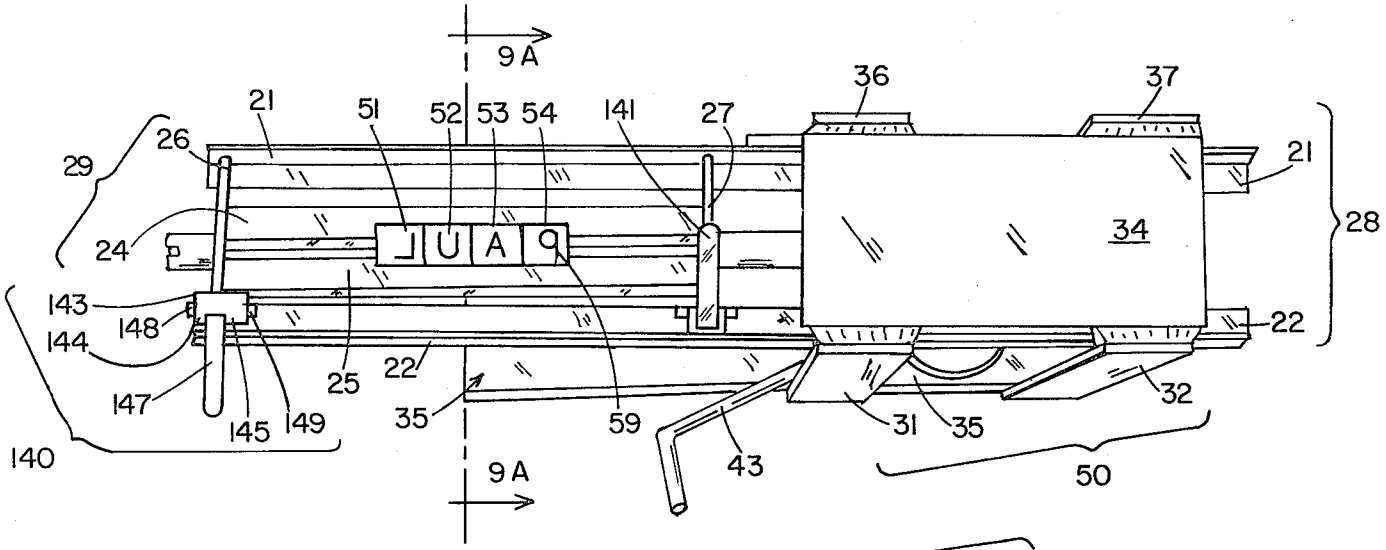
FIG. 5 is a top view of empty apparatus 20 along the direction of arrow 5A of FIG. 1 showing initial loading of dies 51–54 thereon.

The overall apparatus 120 provides for imprinting leather strips such as strip 60 for belting or other decorative purposes. For purposes of reference the left side of FIG. 1 is the front of apparatus 120 while the right side as shown in FIG. 1 is its rear; the left side in FIG. 2 is the left hand side and the right side as shown in FIG. 2 is the right hand side of apparatus 120. The apparatus 120 comprises a rigid main fixed frame 50, a vertically movable die carrier jig support frame 28, a pressure developing means 40 and a horizontally movable die carrier jib assembly 29. The pressure developing assembly 40 is attached to the top of the base 35 of the main frame 50 and is also firmly attached to and moves the die carrier jig support frame 28. The jig support frame 28 provides support for the movable die carrier jig 29.

The main frame 50 comprises a base 35, vertically extending side frame members 31, 32, 36, 37 and a transverse anvil member 34. The base is usually located in a horizontally extending position as shown in FIG. 1 and is parallel to the flat rigid anvil member 34. The base is firmly attached to the bottom ends of the vertically extending side frame members 31, 32, 36, 37 and the upper ends of the side frame members are firmly attached to the anvil member 34. The side frame members are rigid steel bars each of equal size and transverse in shape and extend vertically parallel to each other. The members 31, 32, 36 and 37 are firmly fastened at right angles to the base 35 and are firmly fastened at and extend at a right angle to a rigid heavy anvil plate 34 at the top thereof. A fixed frame enclosure 38 is located between the plate 35 and the anvil 34 and between the sides of the members 31, 32, 36 and 37. A jack assembly 40 is located in the fixed frame enclosure 38. Plate 34 has a flat smooth imperforate horizontal bottom face 48 and is a thick steel plate.

The jack assembly 40 comprises a rigid fixed piston cylinder portion 41 and a movable piston portion 44, and a control mechanism 49. The piston cylinder 41 is firmly attached to and supported on the base 35 and the piston portion 44 is movable within the cylinder 41. The upper portion of the piston is firmly attached to the die carrier support frame plate 23 and rigidly supports it. A rigid straight jack handle rod 42 is attached to a control mechanism 49 which is operatively attached to the jack assembly to move its piston portion relative to the fixed cylinder portion in conventional manner. The movable piston 44 is movable relative to the fixed cylinder portion 41 and the base 35 in a direction parallel to the length of the side members i.e. vertically, transverse to the length of the base 35 and to the lower face of the anvil member 34.

Figure 6:
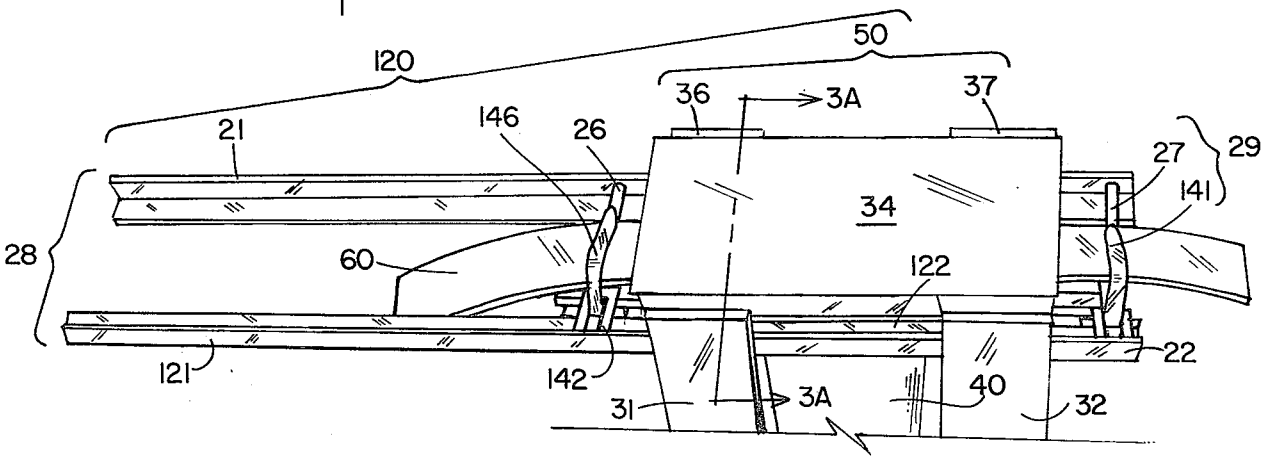
FIG. 6 is a top view of the loaded apparatus of FIG. 1 during the position of parts thereof wherein a leather strip 60 is being impressed as shown in FIGS. 4 and 24.

The die carrier jig support frame 28 comprises a pair of rigid parallel spaced-apart L-sectioned side members 21 and 22. Each of these side members as 22 has one portion thereof as 122 which extends between the anvil member 34 and the die support frame plate 23 and which is firmly attached to that die support frame plate by welded joints as 46 and 47 whereby the entire support frame 28 is vertically movable by the jack assembly 40 relative to the anvil plate 34. A second portion 121 of each of the side members as 22 is contiguous with and fixed to the first part as 122 of such side member as 22. The second portion as 121 of each of the side members as 22 extends laterally to one side of the fixed frame enclosure 38 as shown in FIGS. 1, 5 and 6 and likewise for corresponding portions of side member 21.

The die carrier jig assembly 28 comprises a pair of like rigid straight longitudinal die support plate members 24 and 25, each having a smooth flat upper surface 124 and 125 respectively as shown in FIG. 9 and transversely extending rods 26 and 27. Surfaces 124 and 125 are co-planar; the lower surfaces of members 24 and 25 are co-planar.

The die support plate members 24 and 25 have a uniform rectangular transverse cross section throughout the length thereof and especially in the portions thereof within the enclosure 38 and have equal transverse cross sections within the enclosure 38. The die support members 24 and 25 extend parallel to each other and are spaced apart by the width of a die tongue slot 128. The members 24 and 25 are rigidly and firmly attached at their ends to rigid dimensionally stable jig assembly support member rods 26 and 27. These rods have a smooth sliding fit on members 21 and 22 and serve as spacing as well as support members for members 24 and 25 and maintain members 24 and 25 in fixed spatial relationship to each other and to the side members 21 and 22 and thereby provide for a fixed position and orientation of the slot 128 relative to the side members 21 and 22. A plurality of dies as 51, 52, 53, and 54, each bearing letter dies as "P", "A", "U" and "L" as shown in FIG. 5, are each formed with a rigid body 71 on the top of which are firmly and fixedly supported die cutting edges as 72 and on the bottom of which is located a tongue 73. The tongue 73 has smooth flat vertical walls and slidably and smoothly fits between the neighboring vertical edges 126 and 127 of the die support plate members 24 and 25 on each side of the slot 128.

The bars 24 and 25 are rigid hollow square or rectangular sectioned steel bars that have a greater depth, measured vertically along edges as 126 and 127, than do the tongues of the dies, thereby application of force and vertical displacement by plate 23 acting through rigid L-shaped members 21 and 22 and directly on members 24 and 25 is applied evenly to the edges of all dies in the array of dies held on jig assembly jig assembly 29. The support members 26 and 27 are rigid steel rods or square sectioned beams and have their bottom edges higher than the bottom edges of the die support plate members 24 and 25 while the top surface or edges of support rod members 26 and 27 extend above the level of plates 24 and 25 but below the level or height of the body of the dies, as 51–54, carried by jig assembly die support members 24 and 25.

The front support rod member 26 and rear support rod member 27 each support a clamp assembly, 140 and 141 respectively.

The base of each of the like front and rear releasable snap clamp assemblies 140 and 141 are respectively attached to the front and rear support bars 26 and 27 of carrier jig assembly 28.

The front snap clamp assembly 140 and rear snap clamp assembly 141 are alike so the description of operation and parts of assembly 140 applies to assembly 141. The clamp assembly 141 comprises a rigid clamp base unit 142 and a pivotal clamp arm 146. The base 142 is composed of a rigid steel base plate 143 and a pair of front and rear steel spring loaded resilient base snap locking arms 144 and 145; those arms 144 and 145 are firmly held to the base plate 143 on either side of pivotal arm 146.

The pivotal clamp arm 146 comprises a rigid steel strip holding portion 147 and a pair of rigid flat rectangular front and rear snap ears 148 and 149. The front ear 148 and rear ear 149 are firmly yet releasably held by the front and rear locking arms 144 and 145 respectively and snap either into the strip holding position as in FIG. 6 or into the open position as shown in FIG. 2. Clamp 140 is shown in its open position in FIGS. 1, 2 and 5 and in strip holding position in FIG. 6.

Clamp 141 is shown in its closed or strip holding position in FIGS. 3, 5 and 6. The clamps 140 and 141 serve to hold strips as 60 in fixed position on the die carrier jig assembly 29 and in fixed position relative to dies as 51–54 when that strip is initially oriented and positioned on such jig assembly and dies and also while the strip 60 is carried on such dies and jig to a position as shown in FIGS. 3, 4, and 6 whereat the strip is acted upon by the dies as 51–54 or other dies carried by the carrier assembly 29. The strip of leather 60 comprises an outermost high density surface layer 131 and, immediately therebelow, an intermediate compressed layer 132 which is located over a base, porous, layer 133.

Figure 7:
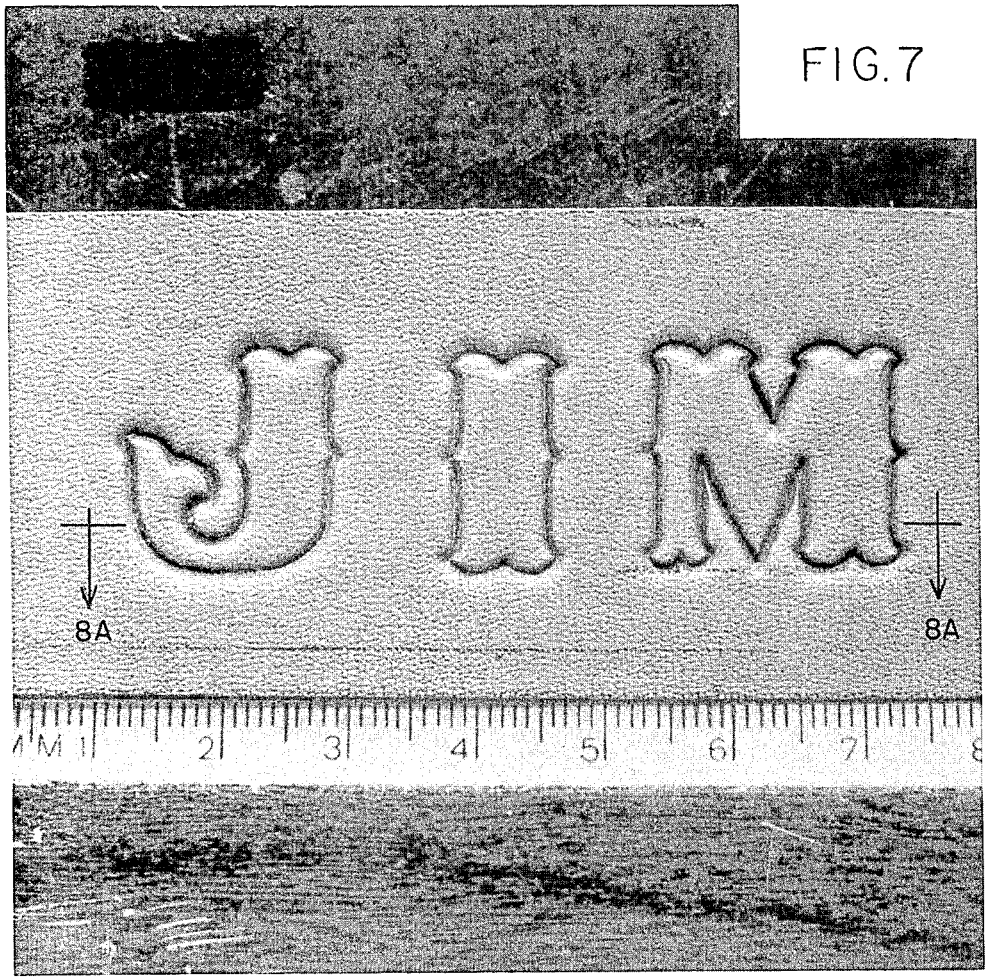
FIG. 7 is a macrophotograph of the surface of a leather belt portion imprinted with the name "JIM" and showing texture thereof and with a scale graduated in millimeters and centimeters with the centimeters shown by the reference numbers 1–8.
Figure 17:
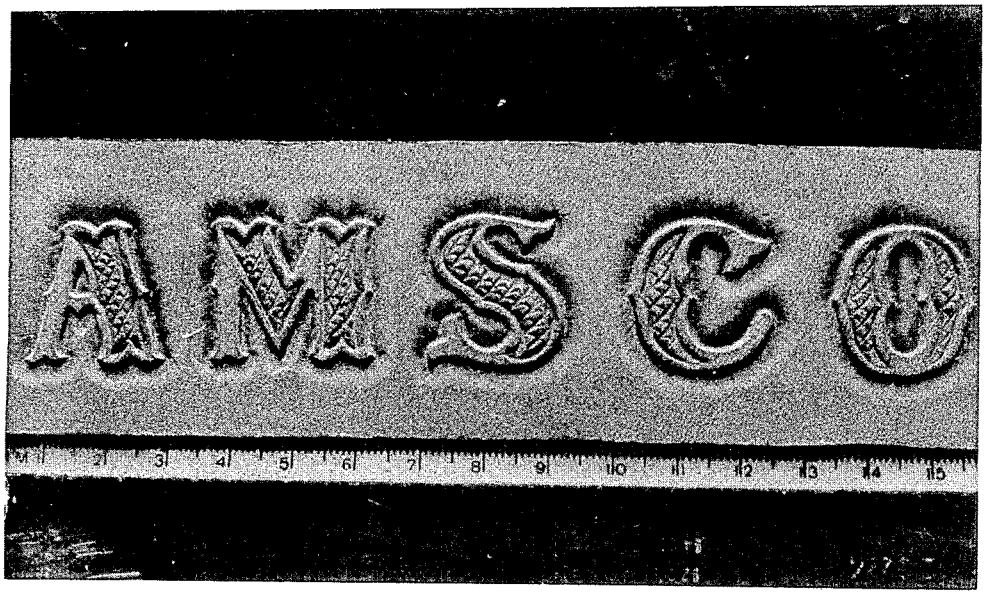
FIG. 17 is a macrophotograph of surface texture and structure of another leather strip imprinted by the apparatus 120 with the name "AMSCO". This figure is provided with a scale graduated in millimeters and numbered centimeters (1–15) to show the size of components shown in this macrophotograph.

In operation a strip of leather 60 is placed on the die carrier jig assembly 29 and held there by the clamps 140 and 141 while the jig assembly 29 is held on the carrier support frame 28 and the carrier support frame 28 is in its lowered position as shown in FIG. 3. The die carrier jig assembly 29, with the dies as 51–54 and the leather strip 60 held thereon, is then slidably carried by the frame 28 into the enclosure 38 and positioned as shown in FIG. 6 with the leather strip located between the smooth horizontal bottom face 48 of the anvil 34 and the top edges of the dies as 51–54 or other dies held on jig assembly 29 and used to form letters as shown in FIGS. 7, 10 or 17.

After so positioning the dies and strip and anvil the jack handle rod 42 is actuated to move the jack piston 44 upward which concurrently moves the rigid die carrier support frame plate 23 attached thereto upward and also concurrently moves upward the side members 21 and 22, which side members 21 and 22 are firmly attached to the plate 23. The die carrier jig assembly 29 arms 26 and 27 are supported on and move with the support frame side members 21 and 22 of the movable die carrier support frame 28.

The press or jack 40 is attached to base 35 in a firm and dimensionally stable manner. The fit of the piston 44 in the cylinder 41 therefor is smooth and close. The plate 23 has such a smooth sliding fit against the interior surfaces of the vertical frame members 31, 32, 36 and 37 that the jig support frame 28 and the jig assembly 29 move in straight lines to and from the anvil plate 34, and smoothly.

Each of the dies as 51–54 is supported on the central rigid die carrier members 24 and 25 and accordingly are moved upward concurrently against the leather strip 60 by the jack piston 44. The teeth as 72 of each of the dies in the array of dies held by jig assembly 29 then engages the leather surface and, as below described, provides an even embossing effect on the leather strip 60 by all edge portions of all of the dies of the array of dies held on the jig assembly 29.

Figure 8:
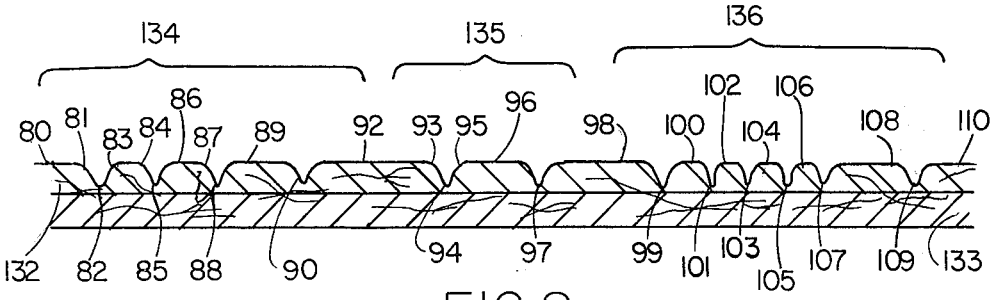
FIG. 8 is a diagrammatical transverse sectional view along the section 8A—8A of FIG. 7.

As shown in FIGS. 7 and 10, letters of the same logo or style have different lengths or shapes of perimeter or both e.g. the letter "I" has, as shown in FIG. 7 less perimeter length than does the letter "M". Also the letter "I" has a lesser perimeter than do the straight edged letters as "W", "N", "H", "L", "Z", "X", "T", "F" and "E" of the same logo and vertical height. Letters of different perimeter length although having straight edged shape (as "I", "H", "M") provide differing resistances to the formation of such letters on the strip of leather when the same depth of the die edge for each such letter is forced into the surface of the leather. Additionally, other letters of the same logo and size such as "I", "J", "P", "L" and "T" have substantially the same length along parts of the perimeter of the die but have different shapes at their end. For example, the letter "J" has the lower portions of that letter close to each other, as shown in FIG. 8, with corresponding different resistances to formation of such letter by impressing the die therefor against the surface of the strip of leather 60 when the same depth of die edge for each such letter is forced into such leather surface. Yet other letters, as "C" and "R" and "S" as shown in FIG. 10 have portions of their perimeter close to each other with corresponding different resistance to formation of such letters than for straight edged letters as "L" and "I" on impressing the die therefor against the surface of the leather strip when the same depth of die edge for each such letter is forced into such leather surface.

Figure 21:
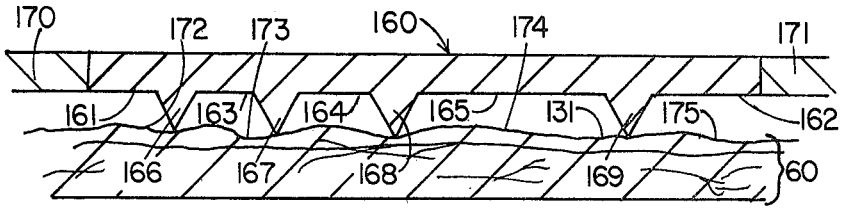
FIGS. 21–25 diagrammatically show successive steps in the formation of the formed and ruptured layer 131 of FIGS. 7 and 10.
Figure 23:
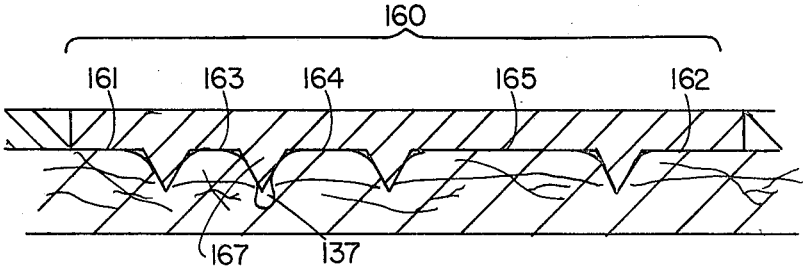
Figure 24:
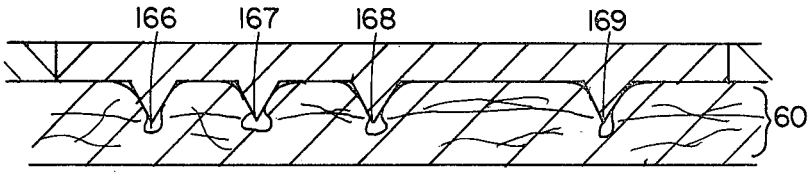
Figure 25:
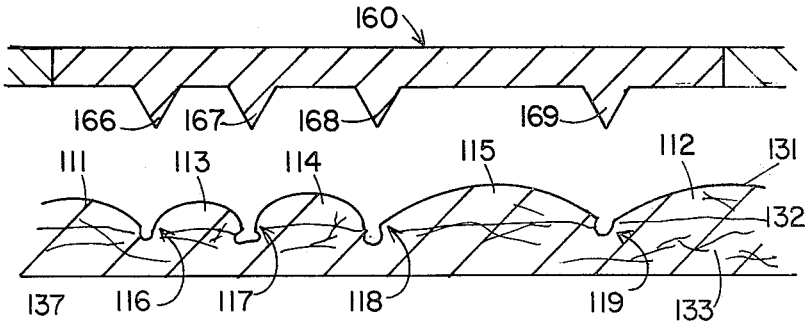

The process of operation of the apparatus 20 to imprint uniformly on leather strips comprises the step of supporting each of several dies in an array providing a name, such as for example the dies 51–54 of FIG. 5 providing the letters "P", "A", "U", and "L" or dies providing the letters "J", "I" and "M" or the letters "C", "H", "A", "R", "L", "E", "S", each letter of such array having different lengths of edge along the perimeter of such letter than another letter of such array or different distances between the edges of each of the components of such letters or both different length of edge and different distances between edges of the letter components, generally as shown in FIGS. 7, 10 and 17. Then as illustrated generally in FIGS. 3 and 4, pressure is concurrently applied via plate 23 to each and all of the dies to force their projecting edges and surfaces against the leather surface as shown more particularly in FIGS. 21–24. Initially the edges of each die as edges 166, 167, 168 and 169 of the die 160 forming the letter "A" in FIG. 10 are pressed against the leather surface 131 as shown in FIG. 21 and edge of die 170 (for letter "H") and die 171 (for letter "R") adjacent to die 160 are similarly pressed against the to-be-impressed surface 131. The jack assembly, plate 23 and jig assembly 28 provide for concurrently pressing all of the die edges against the leather as in FIG. 21–24 to concurrently press all of the die edges to the same depth relative to the outermost leather layer, 131 while, as diagrammatically shown in FIGS. 23 and 24, rupturing that outermost dense layer of leather, firstly along the die edges as 167 that provide the highest resistance to movement of each die, (as shown in FIG. 23). Continuing movement of the remaining die edges against and into and through the outer most layer 131 provides subsequent, as shown in FIG. 24, rupture of the outermost dense layer of leather 131 all along the length of each of the remaining die edges as 166, 168 and 169, as diagrammatically shown in FIG. 24 whereby, on withdrawal of the die from the leather surface, as shown in FIG. 25, the same depth of slot or recess is provided in the leather surface, as slots 116, 117 and 118 and 119 at the perimeter of each letter regardless of the width of the letter's components between such depressed portions as shown for letter "A" in FIGS. 10–15.

The texture of the surface of such product is shown in FIGS. 7 and 10 as seen by the naked eye. As shown in FIG. 8, where the section 8A—8A of FIG. 7 is shown, the letter "J" has portions shown in section in zone 134, the portions of letter "I" in transverse section is shown in zone 135 and the portions of letter "M" are shown in sectional view in zone 136. As shown in FIG. 8 the formed portion of the letters comprise (a) an outer textured portion of surface 131 outside of or lateral or peripheral to the word and letters such as 80 and 110 peripheral to the letters "J" and "M" respectively and (b) (i) outer textured portions as 92 between the letters "J" and "I" and (ii) outer textured portion 98 of surface 131 between the zones 135 and 136; additionally (c) there are outer textured leather surface portions (86) between recesses or slots (85 and 88) at edges of the same letter such as in zone 134 and outer textured leather surface texture portions as 96 (between edges 94 and 97) in zone 135 and outer leather surface portions 100, 102, 104, 106 and 108 in zone 136 (between recesses or slots as 99, 101, 103, 105, 107 and 109 at the edges of the letter in zone 136) and (d) depressed ruptured slot portions edges as 82, 85, 88 and 90, 94, 97, 99, 101, 103, 105, 107 and 109 and (e) smooth shoulder portions as 81 and 83 between the raised portions as 80 and 84 and the depressed neighboring recessed surface portions as 82. A shoulder 87 is also shown between raised portion 86 and recess or slot 88. These shoulder portions are stretched dramatically and are smooth as shown in FIG. 7 and 10; such shoulder portions are illustrated by reference numerals 81, 83 and 86 for the letter "J" in zone 134 of FIG. 8.

The letter "I" comprises a raised central portion 96 and depressed portions at the letter edges as 94 and 97 (which recessed portions correspond in structure to the recessed portions 82, 85 88 and 90 in zone 134). The shoulder portion 93 between portions 92 and 94 and shoulder portion 95 between portions 94 and 96 respectively are also stretched and smooth in the same manner as the shoulder portions of the letter "J".

The letter "M", shown in section at zone 136 of FIG. 8, has outer textured portions as 100, 102, 104, 106 and 108 between depressed or slotted outer edge portions as 99, 101, 103, 105, 107 and 109. The distance between the top-most or outer surface portion as 86 between the letter edges as 85 and 88 of one letter, in the array formed by apparatus 20 is the same as the corresponding distance, from 96 to 94 and from 100 to 101 in all other letters of such array, as shown in FIGS. 7, 8, 10 and 12.

As shown in FIGS. 10 and 11 the apparatus and process of this invention provide for use of other dies than the particular ones providing the name "JIM", such other dies having different letter shapes and sizes; thus, in the showing of FIG. 10 seven letters occupy a length of 17 centimeters while in FIG. 7 three letters occupy a length of 6 centimeters.

As is shown in FIG. 7 looking in a direction transverse to the leather surface the rupture of the surface layer 131 at the bottom of the depressed portions 82, 85, 88, 90, 94, 97, 99, 101, 103, 105, 107 and 109 can be observed.

Figure 14:
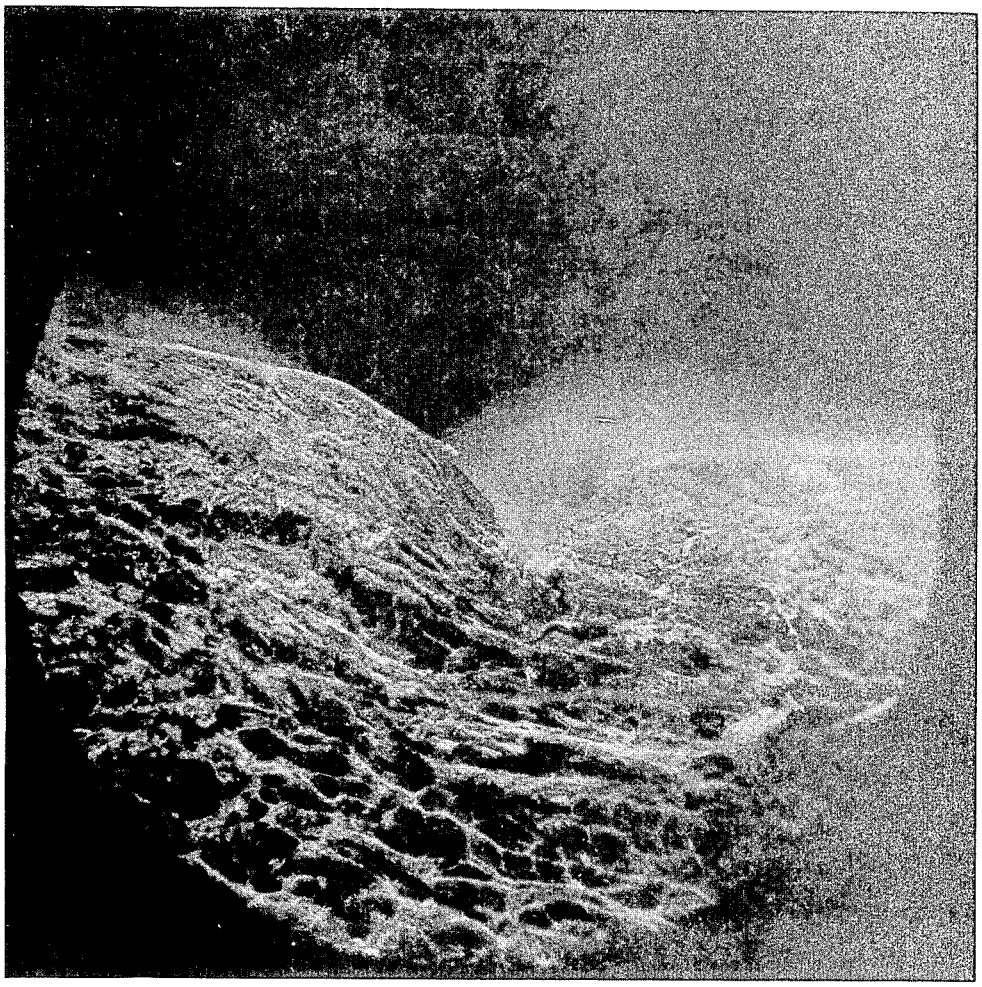
FIG. 14 is an enlarged macrophotographic transverse sectional view of the portion of lettered belting indicated by zone 14A of FIG. 13 and the corresponding portion of FIG. 13.
Figure 15:
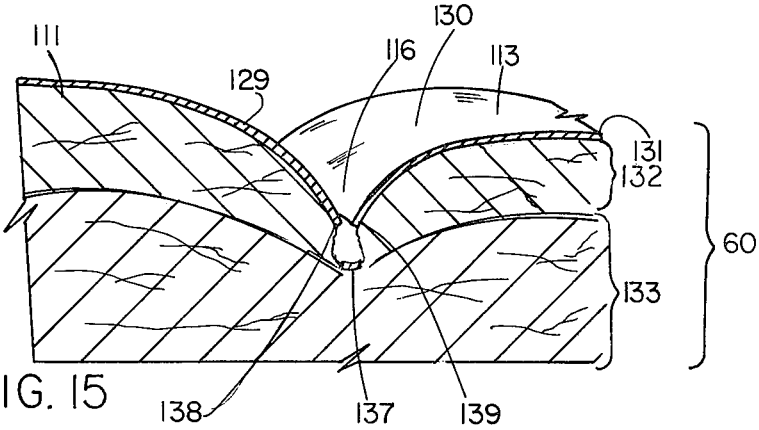
FIG. 15 is a reduced in scale diagrammatic line drawing of the macrophotograph shown in FIG. 14 for purpose of application of reference numbers thereto without interfering with the showing of details of texture and structure shown in FIG. 14.

Additionally to the particular letter structure shown in FIG. 7, as shown in FIG. 12, the portions between the letters "H" and "A" (portion 111 of FIG. 13) and the portion between letter "A" and "R", (portion 112 of FIG. 13) and the outer portions between the edges of the same letter (A) as 113, 114, and 115 are at the same height while the lowest portion of the depressed portions of the letter edges as 116, 117, 118 and 119 are, like the depressed portions 82, 85 and 88 in portion 134 of FIG. 8, all at the same depth relative to the outer portions as 113, 114 and 115 and are ruptured at their bottom edge. The letters "C" "H" "A" "R" "L" "E" and "S" are of the same logo as the letter "JIM" of FIG. 7 but of different size. Notwithstanding the difference in shape of various letters of about the same perimeter, such as letters "R" and "A" and "H" and "E" of FIG. 10, the depressed portions or slots thereof, as 116 and 117 and 118 and 119, are all of the same maximum depth relative to the upper surfaces, as 113, 114, 115, of the letter surface formed into the letter design, as shown for the letter "A" in FIGS. 12–15 and all are similarly ruptured at their maximum depth as at zone 137 (FIGS. 14 and 15). Such structure of the product, as shown in FIGS. 7 and 10–15 provide great sharpness and uniform appearance because the cut portion or edges as 138 and 139 of the upper surface 131 expose to the exterior surface of the coarse darker colored fibrous mass of layer 132. Such layer 132 has a much darker appearance than the smooth exterior surface 131 of the stretched leather located in the shoulder portions as 129 and 130 and 83 and 87 of the embossed surface adjacent to the ruptured layer 131 and provides a crisp clear delineation of the letter edge which produces a particularly artistic and ornamental letter design that clearly stands out to the naked eye. As shown by FIG. 10, which is substantially full size, the cut edges as 138 and 139 are not readily visible by the naked eye, and by FIG. 12, which is over 2× (twice) magnification and wherein the cut edges 138 and 139 are clearly visible, as also in FIG. 14, the reason for such visual effect of outline crispness is not immediately consciously apparent to the naked eye. FIG. 14 is a greatly enlarged portion of zone 14A of FIG. 11 and shows a zone of rupture as 137 provided with very sharp rupture zone edges 138 and 139 that provides the sharpness and distinctness of the edges in the letters as shown in FIGS. 7 and 10.

Figure 26:
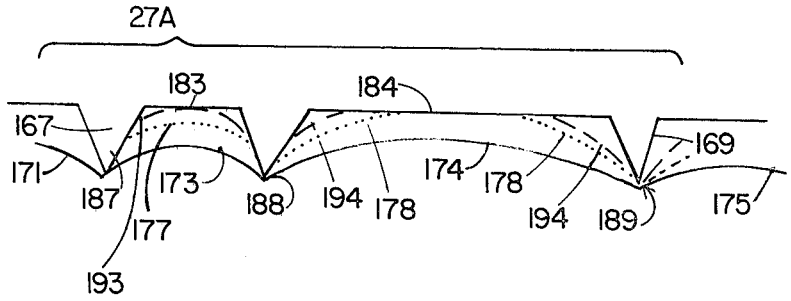
FIGS. 26 and 27 diagrammatically illustrate details in the formation of the textured portion and shoulder portion of the surface of FIGS. 7 and 10–15.
Figure 27:
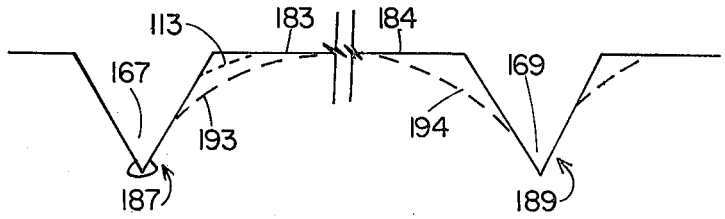

As diagrammatically shown in FIGS. 21, 26 and 27, the movement of die edges as 167–169 toward the leather surface 131 forms (a) contact zone areas as 187–189 where the die edges as 167–169 contact the leather surface 131 and (b) free leather surface zones as 172, 173, 174 and 175 adjacent thereto as shown in full lines in FIGS. 21 and 26.

Figure 22:
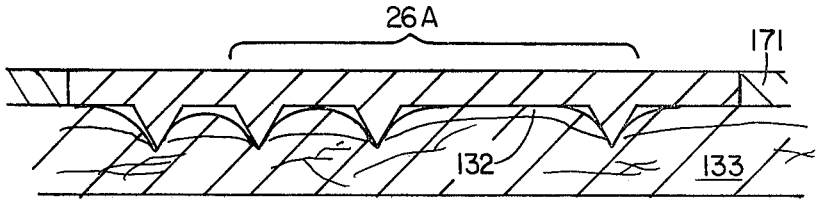

Movement of the die edges toward and into the leather surface initially stretches the leather as shown in dotted lines 177 and 178 in FIG. 26 and locates portions of the initial free leather surface spaced away from the die edges against the die face base portions 161, 163, 164, 165 and 162 as shown in FIGS. 22 and 26. Those portions of the initially free leather surface then positioned forcefully against the die face base portions, as leather surface portions 183 and 184 in FIGS. 26 and 27, shown in dashed lines, are held there against by friction and are then effectively bound thereto, while each remaining adjacent unbound surface portion as 193 between the bound portions as 183 and the die edge as 167 and unbound surface portion 194 between bound portion 184 and contact zone 189 continues to be stretched and is made smooth before rupture occurs along the die edges as 167 and 169 while the die moves into the leather surface as shown in FIGS. 23 and 27.

Extension of the surface leather in each unbound zone as 193 between (a) the bound zone as 183 in contact with the die base surface as 163 and (b) the die edge 167 causes rupture of the outer leather surface 131 adjacent to die edge 167 as at zone 137 in FIGS. 14 and 15. The wider die base zone as 164, with greater spacing between die edges adjacent thereto as 168 and 169, permits stretching of the unbound zone surface to a greater absolute amount—although the same percentage amount—than is possible between the zones of contact of the more closely neighboring die edges 167 and 168 and the leather surface 131 hence rupture occurs first adjacent the narrower die zones as 163 and later adjacent the wider zones as 164 and 165, as at edge 169.

Notwithstanding the different resistances of different portions of the leather surface to the die movement and action, the apparatus 120 operation provides for uniform depth and structure of all letter edges formed by the die in the array of dies held by the die carrier jig assembly 29.

In another structure and ornamental design produced by the apparatus 120 and a process of this inventon, a filigree surface effect is provided along the shoulder portions as 204 and 205 of the imprintation or embossed structure shown in FIGS. 17 and 19 which illustrate details of the surface structure, while FIGS, 18 and 20 diagrammatically shown such structures.

The filigree effect of fine or detailed ornamental surface structure and design comprises, as shown in FIGS. 19 and 20 at filigree surface 204, outside of exterior letter boundary 202 and adjacent thereto, and at filigree textured surface 204, outside the interior letter edge 201 and adjacent thereto, a uniform surface array of relatively raised and relatively depressed portions. Each of the depressed portions as 211 covers substantially the same area, about 0.05 millimeters long by 0.02 millimeter wide, and extends downward into the unbroken leather surface for about 0.02 millimeter: each of said depressed portions has substantially the same diamond shape. The shape of each of such depressed portions as 211 forming the filigree effect is defined by (a) a first set of two upper or outer parallel curved edges as 207 and 208, each extending in a plane oblique to the bottom edge of a groove as 201 or 202 by a die edge as 214 (FIG. 28) and (b) a second set of two parallel deeper curved edges as 209 and 210, each extending in a plane oblique to the curved path of the adjacent die edge as 202 and also oblique to the first set of upper parallel curved edges as 207 and 208.

The bottom of each of the depressions as 211 is flat and generally of diamond shape; the sides thereof are sloped and relatively flat. The relatively raised portions or edges 207 and 208 extend in the same surface as the undeformed surface portion of the leather as 212 and 213 exterior to the filigree zones 204 and 205. A relatively smooth area is provided between the letter edged depressions 201 and 202; that area, 203, presents a surface that has some of the surface irregularities characteristic of natural leather, but, because it is smooth, clearly stands out from the non-smooth filigree surface areas at shoulders 204 and 205 and the embossed area as 215 located interiorly of letter edge depressions as 201 and 202 (shown in FIG. 16.)

Figure 28:
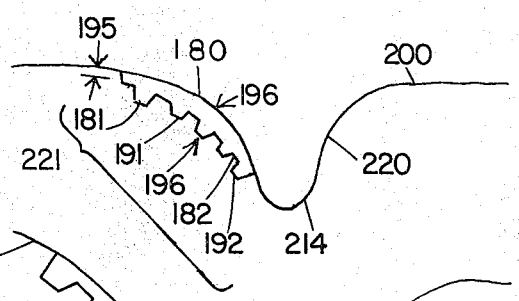
FIG. 28 is an enlarged diagrammatic sectional view of one die edge used to form the embossed structure shown in FIG. 19 and is a diagrammatic sectional view along a plane as 28A—28A of FIG. 20 and plane 28A of FIG. 19.
Figure 29:
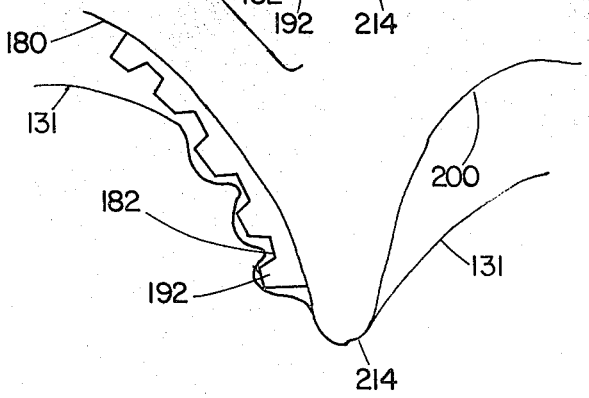
FIG. 29 is an enlarged view as in FIG. 28 during operation of such die edge.

For the texture and imprint structure shown in FIGS. 17–20 a die as shown in FIG. 28 is used. Such die comprises a rigid base portion as 200 (like 160 in FIG. 21) and a plurality of rounded tip edges as 214 supported on base portion 200 (as die edges 166–169 are supported on base 160). Each tip edge as 214 is adjacent to and supported on a rigid steel inner outwardly concave smooth shoulder 220 and an outer outwardly concave toothed rigid steel shoulder portion 221. The tip edges as 214 are arrayed in the form of letters as shown in FIG. 17 in mirror image of the die. Each such outer shoulder portion has an array of many like sets of projecting filigree-forming teeth on the outer side of the tip of each protruding die edge. Such array of filigree-forming teeth comprises (a) an outwardly concave curved base surface 180 and (b) a series of small teeth about 0.25 millimeter wide, as 181 and 182, each projecting by a first short distance 195 from the surface 180 and (c) a second series of like teeth, as 191 and 192 each projecting parallel to teeth as 181 but at a second, longer distance 196 (longer than 195) from the base surface 180 as shown diagrammatically in FIG. 28. The actual size of the teeth may be approximated from the scale provided in FIG. 17 (from which the distance across the width of the portion of letter "C" shown in FIG. 19 is shown to be 3.0 millimeters and from which the dimension of the filigree may be measured off on FIG. 17). During (downward as shown in FIG. 28) motion of the die shoulders relative to the leather surface 131 the array of teeth as 191 and 192 adjacent to the die extremity as 214 extend transversely to the horizontally extending leather surface as shown in FIG. 28 and successive portions of such array of dies as 192 and 182 located successively laterally of the lower-most (as shown in FIG. 29) die edge successively engage successive portions of the leather outer surface located laterally of the die edge 214 and draw those surface increments or portions downwardly (as in FIG. 29) without rupture a short distance along with and together with the downward movement of the die edge. No rupture occurs in surface 131 at the die edge as 214 because the depth of penetration of the die is kept small; however the shading effect of the filigree in the shoulder zone as 204 and 205 produces a marked contrast with the smooth surfaced letter-defining portion located between die edges 201 and 202.

Thereby, for the filigree surface of FIG. 17–20 the multiple die edges as 181 and 182, 191 and 192 produce a filigree effect by engagement with neighboring increments of the leather surface. Such engagement draw the neighboring leather surface increments in each broad shoulder zone 205 [which zone extends laterally of the edge 214] of the die into surface 131 together and concurrently as shown in FIG. 29 rather than concentrating the compressive stresses of the die against the leather surface only in a narrow or substantially linear zone of contact along the bottom of each edge, as 214, of the letters.

In this operation producing letters as in FIG. 17, as in the operation producing the letter embossed structure of FIGS. 7 and 10 the linear or curved edges or both on the different letters creates greater resistance to deformation and penetration of the leather surface by the dies when such different letter edges are closer to each other or when there is a greater linear length of the peripheral edge of such different letters. Nevertheless the same depth of maximum die edge penetration and the same design on the shoulder of each letter edge is provided by the apparatus and operation herein described.

Not only does this apparatus and process provide for the above described firm and ready positioning of the dies and the distinct grades of texture provided by the apparatus with the portion of the leather between the die edges having one texture as shown in FIGS. 7 and 10 and 17 and the embossed portion formed by the die edges, as shown in FIGS. 7, 10 and 17, having a particularly smooth texture which contrasts with the texture of the leather between die edges in a uniform manner, but also the uniformity of the cutting action in the structure shown in FIGS. 7 and 10 provides that when standard pressure-sensitive stretchable paper-base drafting tape may be and is applied to the leather surface over the entire area of the leather surface of the strip 61 for the length of leather surface to which the embossing action is applied, such application of tape made before the cutting action shown in FIGS. 3, 4, and 21–25 is initiated, after such cutting action of the dies as 166–169 ( shown in FIG. 21–25) is completed, with rupture of the tape as well as the leather layer 131, the portion of the tape overlying the leather surface as 96 interior to the slots as 94 and 97 formed by the die edges may be readily and completely and cleanly removed, with the remaining portion of the tape adherent to the leather surface providing a shield or template for applying paint or strains to the exposed portion of the leather surface. Alternatively, the tape adherent to the leather surface portions as 96 may be left intact on such surface to serve as a shield and the tape overlying the leather surface exterior to the depressions or slots at the letter edges, as 94 and 97, be readily and completely and cleanly removed and stain or paint later applied to the then remaining exposed portions of leather surface. The stain or paint is applied by spray.

Standard leather die paints are available and may be provided e.g. by Shucare Enterprises, Box 76401, Los Angeles, CA. 90076 number 17 dark brown which is a vinyl plastic or leather color spray.

In no way than herein described can pressure-sensitive tape be provided with a line of rupture as is provided by this apparatus which, in one deflection or stroke of the array of dies as shown in FIGS. 3, 4 and 21–25, provides a rupture of the tape sufficiently uniform to provide for a subsequent lifting out of the remaining portions of tape. Otherwise several small remains of tape are provided (rather than a clean cut outline) which is undesirable so far as the painting is concerned.

The tape doesn't get down to the ruptured zone at the bottom of the crevices or slots by the apparatus and process herein described (while it can be undesirably located there by a hand hammering technique); also as there is no heat used by the apparatus and process here so there is no gumming up of such tape with this apparatus and process. The particular leather surface 131 is initially flat but it and the die edges could be curved.

Figure 16:
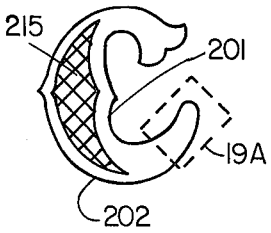
FIG. 16 is a diagrammatic line drawing view of the letter "C" of FIG. 15.
Figure 18:
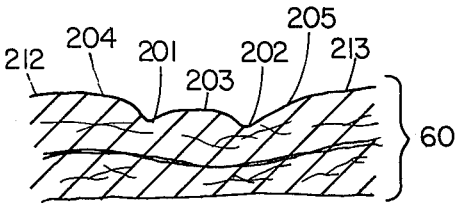
FIG. 18 is a diagrammatic line drawing cross-section view along section 18A—18A of FIG. 20.

The uniformity of the surface produced interior of the embossed portion as at zone 203 of FIGS. 16–18 allows secondary designs as at 215 to be put specifically in that and like surface portions which have a uniform texture initially. It takes 10 to 15 minutes for a skilled craftsman to apply four letters as shown in FIG. 10 or 17 to a leather surface by hand, aside from any intermediary designs (that would take 3 to 4 times as long) and would fail to provide the uniformity of texture that is provided by the relatively simple apparatus 120.

The leather may be treated with a sealer prior to its embossing. The darker color is exposed by this embossing and is exposed to a uniform depth and color.

The diesas 160, 170 and 171 used in the operation shown in FIGS. 21–27 are formed of hard steel and have a generally triangular shape, with flat surfaces on the sides of the die edge between the die base surfaces as 161–163 and the die edges as 166–169.

The jack assembly 40 is, in the exemplary embodiment above described, a standard $12\frac{1}{2}$ ton jack.

The assembly 120 is $13\frac{3}{8}$ inches high from bottom of base 35 to top of anvil 34. The vertical plates of L-shaped arms 21 and 22 have a $3\frac{5}{8}''$ space therebetween for the rigid $\frac{1}{4}$ in. diameter round steel jig frame members 26 and 27 while base 35 is 4 inches wide, as is anvil member 34: members 31, 32, 36 and 37 are 2 in.$\times\frac{3}{8}''$ flat stock 13 inches long: base 35 is $20\frac{1}{8}''$ long. Anvil 34 is $8''\times4''\times1''$. Angles 21 an 22 are $\frac{3}{4}\times\frac{3}{4}\times\frac{1}{8}\times21\frac{1}{4}$; members 24 and 25 are $\frac{1}{2}$ in square keystock. Other relations may be approximated from FIGS. 1 and 2 which are pictorial and to scale. The travel of piston 44 is a maximum of $1\frac{1}{4}$ inch. Letters of $\frac{1}{2}$, $\frac{3}{4}$ and 1 inch height are exemplary sizes.

A strong conventional helical spring as 33 is attached at the top to the plate 23 and at the bottom thereof to the base 35 by loops attached to such plate and base and provides for returning the plate 23 to its lowered position (as shown in FIG. 1) after release of pressure upward on the piston 44 by hydraulic fluid in the cylinder 41 the spring yields when the pieces of leather are being operated upon by the dies carried by assembly 29.

For operation of apparatus 120 moving handle 42 to one position, as 45, provides for upward movement of piston 41, and repeated pumping of handle 42 applies greater pressure on the strip 60 held between dies as 51–54 and anvil 34; releasing control arm 43 releases the applied pressure. After inspection of the product formed the same total force can be applied to each strip so that the same displacement of the edge is provided for each die [in the changed array of dies on die carrier jig assembly 29] applied to each strip of leather as 60.

In operation of the apparatus 120, after imprintation of the leather strip as in FIG. 7, 10 or 17, the jack assembly pressure is released and the jig support assembly 28 is lowered and the die carrier jig assembly 29 lowered therewith, and the embossed strip 60 removed from the space between the lower anvil face 48 and the array of dies held on the die carrier jig assembly 29. The operation to form the is manual but rapidly repeated on successive pieces of leather.

As the jig carrier is longer than the anvil from front to rear (as shown in FIG. 6), the jig carrier and the dies thereon may be moved in or out of the enclosure 38 and relative to the anvil by the operator and, as the anvil bottom surface 48 is vertically spaced above the edge top edges of the die support frame members 21 and 22, the strip 60 is viewable by an operator of apparatus 120 between the spaced apart frame member set 31 and 32 and set 36 and 37 so that the strip may be repositioned on the dies carried by the jig assembly 29 for added uniform stamping and embossing action as needed either while such strip and dies are located in operative array within the enclosure 38 or while the jig assembly 29 and dies and strip are located in operative array exterior to the enclosure 38, as shown in FIG. 5. Accordingly the operator is able to reposition the leather strip on the dies and return the incompletely embossed strip and dies to the enclosure 38 and apply added even pressure and embossing action to all the dies concurrently as needed to obtain the effect desired and above described. The pressure used in this operation (12½ tons for 1"×7 inches for ¾ inch high letters as used for the name "Charles" in FIG. 10 and less area for the letters "JIM" in FIG. 7) exceeds 3,000 pounds per square inch and may be as high as 12,000 pound per square inch of die surface. Thereby, for the product shown in FIGS. 7 and 10 the edges as 161–165 of each of the dies as 160 are relatively shallow so that rupture of the leather layer 131 does not occur until the bound portions, as 183 and 184, of the strip 60 are securely held by the flat die base surface as 161–165. The die teeth are, therefore, sufficiently small that rupture of the leather surface layer 131 does not occur until each of the upper surface portions as 171, 173, 174 is so substantially applied along the flat die base surface portions as 161–165 that stretching only occurs along the shoulder portions. Thereby bound surfaces portions as 183 and 184 are firmly held and the natural texture of such surface portions is preserved and is uniform while the shoulder portions of the leather adjacent the recesses as 116–119 and like portions are selectively stretched and made smooth and ruptured at their bottom to provide sharp delineation between portions of the letters within the letter outlines and the leather surface exterior of the letter outline.

For the particular die used for the formation of letters shown in FIG. 10 the depth or distance of the die edges from the die base surfaces as 161–165 is uniform for all edges of each die as die edges 166–169 of die 160 and other dies as 161, 170 and 171 used for each of the letters 131–137 and is three thirty-seconds of an inch. The term "letters" as used herein also includes numbers. Members 26 and 27 may also be made of rectangular rigid key stock having the same dimensions as longitudinal members 24 and 25. 12 and 20 ton jack assemblies as 40 are available via J. C. Whitney & Co. (Chicago, Ill.) 1978 Catalogue No. 377B, page 63.

I claim:

1. An apparatus for imprinting on leather comprising a main fixed frame, a die carrier support frame, a pressure developing means, and a movable die carrier jig, said pressure developing means attached to said main fixed frame and to said die carrier support frame, said main fixed frame comprising a base, vertically extending side frame members and an anvil member, said base extending parallel to said anvil member and said base firmly attached to one end of said vertically extending side frame members and another end of said vertically extending side frame members firmly attached to said anvil member, said base comprising a horizontally extending rigid plate, said vertically extending side frame members comprising a plurality of like rigid vertically extending beams, said anvil member comprising a rigid vertically and horizontally extending flat bottomed plate, said vertically extending side frame members extending at a right angle to said base and said anvil member extending at a right angle to said vertically extending side frame members, a fixed frame enclosure located between said one end of said vertically extending frame members and said another end of said frame members, said pressure developing means and a part of said die carrier support frame located in said fixed frame enclosure, said pressure developing means comprising a fixed portion attached to and fixedly supported on said base, and a movable piston portion, said movable piston portion movable within said fixed portion, and control means attached to said pressure developing means to move said movable piston portion relative to said fixed portion, said movable piston portion being movable relative to said fixed portion in a direction parallel to the length of said vertically extending side frame members, said die carrier support frame comprising a pair of parallel rigid spaced-apart side members, a first part of each of said pair of parallel rigid spaced-apart side members extending between said anvil member and said movable piston portion and attached to said piston portion, and a second portion of each of said pair of parallel rigid spaced-apart side members contiguous with and continuous with said first part of each of said pair of parallel rigid spaced-apart side members end extending laterally to one side of said fixed frame enclosure, said die carrier jig assembly comprising a pair of parallel rigid straight longitudinal die support members each of uniform transverse cross section and located within said fixed frame enclosure and each with its length extending parallel to said pair of parallel rigid spaced-apart side members and spaced apart transverse to their length and located between said pair of parallel rigid spaced-apart side members of said die carrier support frame and a plurality of jig support members each movably supported on said pair of parallel rigid spaced apart side members and comprising a rigid beam, said die support members each attached at spaced apart portions thereof to said jig support members, and a plurality of dies carried by said die carrier jig assembly, each of said dies comprising a die body, a cutting portion, and a die tongue, said die body resting on said die support members, said cutting portion extending upwardly thereof and said tongue portion attached to said die body and slidably yet firmly located between said die support members.

2. Apparatus as in claim 1 wherein said die body has a flat base surface, said cutting portion comprises sharp edges, and flat sides extending between said flat base surface and said sharp edges.

3. An apparatus for imprinting on leather comprising a main fixed frame, a die carrier support frame, a pressure developing means, and a movable die carrier jig, said pressure developing means attached to said main fixed frame and to said die carrier support frame, said main fixed frame comprising a base, vertically extending side frame members and an anvil member, said base extending parallel to said anvil member and said base firmly attached to one end of said vertically extending side frame members and another end of said vertically extending side frame members firmly attached to said anvil member, said base comprising a horizontally extending rigid plate, said vertically extending side frame members comprising a plurality of like rigid vertically extending beams, said anvil member comprising a rigid vertically and horizontally extending flat bottomed plate, said vertically extending side frame members extending at a right angle to said base and said anvil member extending at a right angle to said vertically extending side frame members, a fixed frame enclosure located between said one end of said vertically extending frame members and said another end of said frame members, said pressure developing means and a part of said die carrier support frame located in said fixed frame enclosure, said pressure developing means comprising a fixed portion attached to and fixedly supported on said base, and a movable piston portion, said movable piston portion movable within said fixed portion, and control means attached to said pressure developing means to move said movable piston portion relative to said fixed portion, said movable piston portion being movable relative to said fixed portion in a direction parallel to the length of said vertically extending side frame members, said die carrier support frame comprising a pair of parallel rigid spaced-apart side members, a first part of each of said pair of parallel rigid spaced-apart side members extending between said anvil member and said movable piston portion and attached to said piston portion, and a second portion of each of said pair of parallel rigid spaced-apart side members contiguous with and continuous with said first part of each of said pair of parallel rigid spaced-apart side members and extending laterally to one side of said fixed frame enclosure, said die carrier jig assembly comprising a pair of parallel rigid straight longitudinal die support members each of uniform transverse cross section and located within said fixed frame enclosure and each with its length extending parallel to said pair of parallel rigid space-apart side members and spaced apart transverse to their length and located between said pair of parallel rigid spaced-apart side members of said die carrier support frame and a plurality of jig support members each movably supported on said pair of parallel rigid spaced apart side members and comprising a rigid beam, said die support members each attached at spaced apart portions thereof to said jig support members, and a plurality of dies carried by said die carrier jig assembly, each of said dies comprising a die body, a cutting portion, and a die tongue, said die body resting on said die support members, said cutting portion extending upwardly thereof and said tongue portion attached to said die body and slidably yet firmly located between said die support members and wherein each of said plurality of such dies comprises a rigid base portion and a plurality of rounded tip edges supported on said base portion, each tip edge adjacent to and supported on a rigid steel inner outwardly concave smooth shoulder and an outer outwardly concave toothed rigid steel shoulder portion, said tip edges arrayed in the form of letters in mirror image of said dies and each said outer shoulder portion has an array of many like sets of projecting filigree-forming surfaces on the outer side of the tip, said array of filigree-forming surfaces comprising:

(a) an outwardly concave curved base surface and (b) a series of small projections, each projecting at a first, short, distance from said base surface and (c) a second series of like projections each projecting a second distance, said second distance longer than said first distance from the said curved base surface.

* * * * *